US007955773B2

(12) United States Patent
Sakai et al.

(10) Patent No.: US 7,955,773 B2
(45) Date of Patent: Jun. 7, 2011

(54) TONER FOR DEVELOPING ELECTROSTATIC IMAGE, DEVELOPER FOR DEVELOPING ELECTROSTATIC IMAGE, TONER CARTRIDGE, PROCESS CARTRIDGE, AND IMAGE FORMING APPARATUS

(75) Inventors: Motoko Sakai, Kanagawa (JP); Masahiro Takagi, Kanagawa (JP); Jun Igarashi, Kanagawa (JP); Tetsuya Taguchi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 101 days.

(21) Appl. No.: 12/389,015

(22) Filed: Feb. 19, 2009

(65) Prior Publication Data

US 2010/0081074 A1 Apr. 1, 2010

(30) Foreign Application Priority Data

Sep. 26, 2008 (JP) ..... 2008-249306

(51) Int. Cl.
*G03G 9/08* (2006.01)

(52) U.S. Cl. ..... 430/108.2; 430/108.24; 430/108.7; 430/110.1; 430/110.2

(58) Field of Classification Search ..... 430/108.2, 430/108.24, 108.7, 110.1, 110.2
See application file for complete search history.

(56) References Cited

U.S. PATENT DOCUMENTS

| | | | | |
|---|---|---|---|---|
| 5,827,632 | A | 10/1998 | Inaba et al. | |
| 2005/0026089 | A1* | 2/2005 | Ogawa et al. | 430/405 |
| 2006/0024600 | A1* | 2/2006 | Sugiura | 430/108.1 |
| 2007/0275257 | A1* | 11/2007 | Muraguchi et al. | 428/522 |

FOREIGN PATENT DOCUMENTS

| | | | |
|---|---|---|---|
| EP | 0 716 350 | A2 | 6/1996 |
| EP | 1 502 933 | A2 | 2/2005 |
| EP | 1 505 448 | A1 | 2/2005 |
| JP | A-2000-181127 | | 6/2000 |
| JP | A-2002-14487 | | 1/2002 |
| JP | A-2002-214834 | | 7/2002 |
| JP | A-2002-323836 | | 11/2002 |
| JP | A-2003-57873 | | 2/2003 |
| JP | A-2004-212861 | | 7/2004 |
| JP | A-2006-293259 | | 10/2006 |

(Continued)

OTHER PUBLICATIONS

European Search Report issued in European Application No. 09163241.4 on Dec. 16, 2009.

Office Action issued in Japanese Patent Application No. 2008-249306 mailed on Jul. 13, 2010 (with English-language Translation).

*Primary Examiner* — Hoa V Le
(74) *Attorney, Agent, or Firm* — Oliff & Berridge, PLC

(57) ABSTRACT

A toner for developing an electrostatic image includes a toner particle to which particles of an external additive A having a number average particle diameter of from 7 nm to 200 nm and particles of an external additive B having a number average particle diameter of from 30 nm to 4000 nm have been externally added. The ratio of the number average particle diameter of the particles of the external additive B to the number average particle diameter of the particles of the external additive A is in a range of from 2 to 20. The particles of one of the external additive A or the external additive B are particles having a core material covered with an organic material containing hydrogen and nitrogen. The particles of the other one of the external additive A or the external additive B are $SiO_2$ particles.

16 Claims, 2 Drawing Sheets

FOREIGN PATENT DOCUMENTS

| | | |
|---|---|---|
| JP | A-2006-308757 | 11/2006 |
| JP | A-2007-304493 | 11/2007 |
| JP | A-2008-58395 | 3/2008 |
| JP | A-2008-070718 | 3/2008 |
| JP | A-2008-070719 | 3/2008 |
| JP | A-2008-158443 | 7/2008 |

* cited by examiner

TONER FOR DEVELOPING ELECTROSTATIC IMAGE, DEVELOPER FOR DEVELOPING ELECTROSTATIC IMAGE, TONER CARTRIDGE, PROCESS CARTRIDGE, AND IMAGE FORMING APPARATUS

CROSS-REFERENCE TO RELATED APPLICATION

This application is based on and claims priority under 35 USC 119 from Japanese patent Application No. 2008-249306 filed on Sep. 26, 2008.

BACKGROUND

1. Technical Field

The present invention relates to a toner for developing an electrostatic image, a developer for developing an electrostatic image, a toner cartridge, a process cartridge, and an image forming apparatus.

2. Related Art

Image forming utilizing electrophotography is performed by charging, exposing, and developing a surface of a photoreceptor to form a toner image; and transferring and fusing the toner image onto a surface of a recording medium.

Generally, external additives are added to toner used at development for a variety of purposes such as securing fluidity and improving cleaning performance.

SUMMARY

According to an aspect of the invention, there is provided a toner for developing an electrostatic image, including a toner particle to which particles of an external additive A having a number average particle diameter of from 7 nm to 200 nm and particles of an external additive B having a number average particle diameter of from 30 nm to 4000 nm have been externally added;

a ratio of the number average particle diameter of the particles of the external additive B to the number average particle diameter of the particles of the external additive A (the number average particle diameter of the particles of the external additive B/the number average particle diameter of the particles of the external additive A) is in a range of from 2 to 20;

the particles of one of the external additive A or the external additive B are particles having a core material covered with an organic material containing hydrogen and nitrogen; and the particles of the other one of the external additive A or the external additive B are $SiO_2$ particles.

BRIEF DESCRIPTION OF THE DRAWINGS

Exemplary embodiments of the present invention will be described in detail based on the following figures, wherein.

DETAILED DESCRIPTION

<Toner for Developing an Electrostatic Image>

Figure 1:
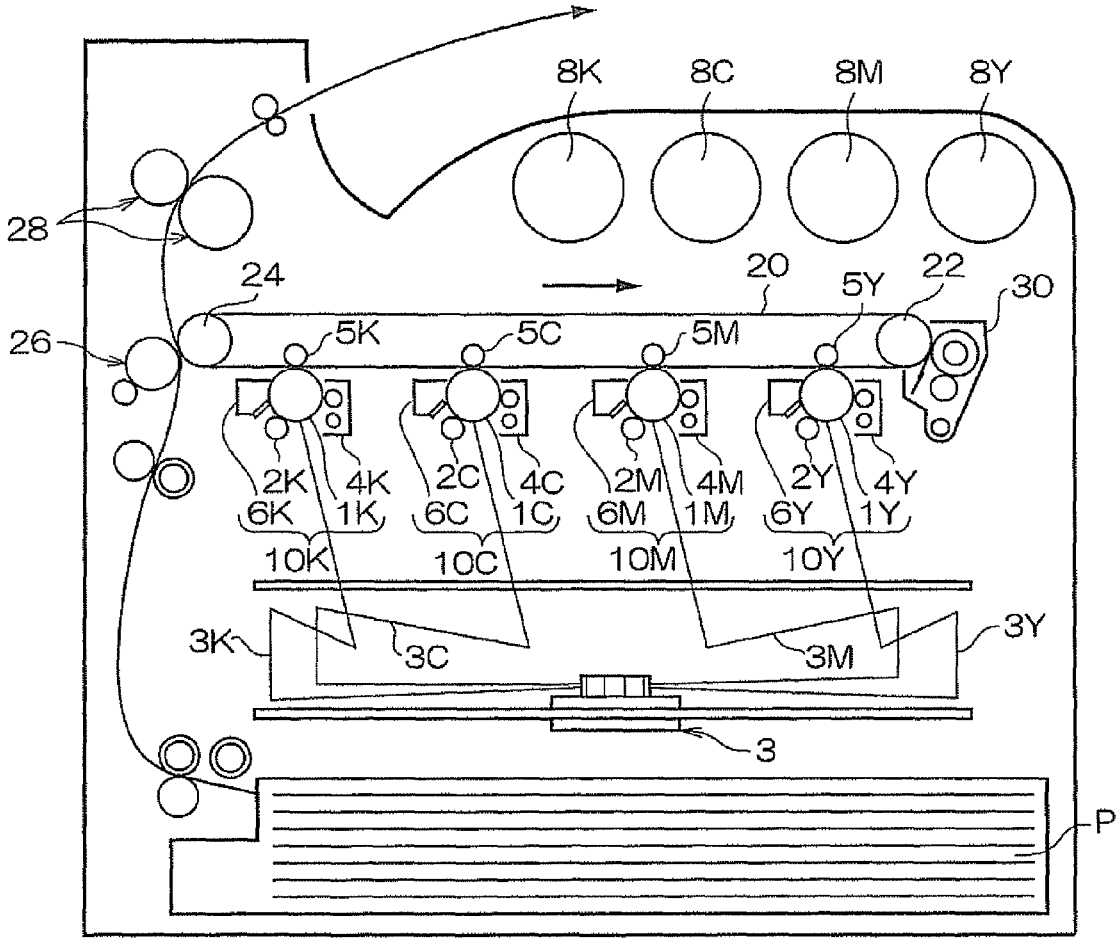
FIG. 1 is a schematic configuration diagram showing an example of an image forming apparatus according to an aspect of the invention.

A toner for developing an electrostatic image according to an exemplary embodiment (hereinafter sometimes referred to as "toner according to an exemplary embodiment") includes toner particles to which an external additive A particles having a number average particle diameter of from 7 nm to 200 nm (or from about 7 nm to about 200 nm) and an external additive B particles having a number average particle diameter of from 30 nm to 4000 nm (or from about 30 nm to about 4000 nm) have been externally added. The value obtained by dividing the number average particle diameter of the external additive B particles by the number average particle diameter of the external additive A particles (the number average particle diameter of the external additive B particles/the number average particle diameter of the external additive A particles; hereinafter sometimes referred to as "particle diameter ratio between the external additives according to the exemplary embodiment") is within a range of from 2 to 20 (or from about 2 to about 20). The particles of one of the external additive A or the external additive B are particles in which a core material is covered with an organic material containing hydrogen and nitrogen, and the particles of the other one of the external additive A or the external additive B is $SiO_2$ particles.

From the viewpoint of space-saving and downsizing of machines, limits on machine layout have been increased. Accordingly, improvement in degree of freedom in machine layout of a discharged toner carrying system such as a discharged toner carrying path (a transfer residual toner carrying unit) for discharging toner after image formation and a discharged toner collecting container has become necessary. The term "transfer residual toner" used herein refers to a toner that remains on the photoreceptor even after transfer process is performed. Therefore, the toner should necessarily be capable of being carried efficiently regardless of the layout of the discharged toner carrying path.

A high proportion of toner particles receive thermal and/or mechanical stresses in a cleaning process, in which the toner particles remaining on an electrostatic latent image holder are collected with a cleaning blade, a fur brush or the like, and/or when the toner particles are stirred in a discharged toner collecting container or a discharged toner carrying path. Therefore, compared with toner particles newly supplied for replenishment, the discharged toner particles are deformed and have altered particle size distribution, external additives have separated from the surface of the discharged toner particles and/or embedded in the discharged toner particles, and the toner particles are contaminated with paper dust and the like.

Therefore, transportability of the toner discharged after image formation is low compared with the newly supplied toner before image formation. When the discharged toner fills a discharged toner carrying path, troubles tend to occur such as clogging of the carrying path at portions at which the carrying path is bent or has a large curvature and image-quality defects (band-like fogs) caused by spout, due to clogging of the carrying path, of the toner discharged from a cleaning unit. For example, the toner particles to be discharged after image formation is subjected to a stronger shearing force if the toner particles are positioned nearer the tip of the cleaning blade in a nip portion (a contact face having a contact width in the moving direction) between the cleaning blade and the surface of a photoreceptor. When a scraping stress is applied continuously to the toner particles accumulated at the nip portion between the cleaning blade and the surface of the photoreceptor in the cleaning process, embedding of the external additives and deformation and peeling of the toner particle surface occur. As a result, fluidity and transportability of the discharged toner are lowered.

When image formation is performed using a conventional toner, an aggregate is formed and remains at or around a contact portion between the cleaning blade and the surface of the photoreceptor due to a scraping force at the nip portion (a contact face having a contact width in the moving direction) between the cleaning blade and the surface of the photoreceptor, whereby a strain of the cleaning blade is increased. As a result, a scraping stress is applied continuously to the toner particles remaining at the nip portion, and thus external additives are embedded in toner particles and deformation and peeling occurs at surfaces of the toner particles, leading to decrease in fluidity and transportability of the discharged toner and developer. As a result, troubles tend to occur such as clogging of the carrying path at portions at which the carrying path is bent or has a large curvature and image-quality defects (band-like fogs) caused by spout, due to clogging of the carrying path (after-mentioned transfer residual toner carrying unit), of the toner discharged from a cleaning unit. In the present specification, a toner particle to which an external additive has not been externally added is sometimes referred to as a bare toner particle.

As described above embedding of external additives in toner particles and deformation and peeling at surfaces of toner particles are considered to occur through the following process. During repetition of the process of removing the transfer residual toner particles by scraping with a cleaning blade, particles having a smaller particle diameter are accumulated near the tip of the cleaning blade in the nip portion between the cleaning blade and the surface of the photoreceptor, and the particle diameter of the accumulated particles increases with the distance from the tip of the cleaning blade. Specifically, the following particles are accumulated in the order from nearest to the tip of the cleaning blade to the farthest from the tip of the cleaning blade: external additive particles having a smaller particle diameter, external additive particles having a larger particle diameter, and, further, toner particles. In this state, it is considered that the toner particles receive a large scraping stress, whereby external additives are embedded in toner particles and toner particle surfaces are deformed and peeled. The present invention has been made in consideration of such a phenomenon.

In the next place, the particle diameters of the external additive A and the external additive B will be described.

In the present exemplary embodiment, the number average particle diameter of each external additive is measured as follows.

An external additive to be measured is diluted with ethanol, and dried on a carbon grid for a transmission electron microscope (TEM: JEM-1010 trade name, manufactured by JEOL DATUM Ltd.) and observed by the TEM (×50000). The image is printed out, 100 primary particles are randomly extracted as samples, the particle diameter of each particle is obtained as the average value of the major axis length and the minor axis length, and an arithmetic mean value of the particle diameters for the 100 primary particles is used as the number average particle diameter of the external additive.

When an external additive to be measured has externally added to toner particles, the number average particle diameter of the external additive may be measured as follows. The images of 1000 particles of the external additive are obtained by observation (×50000) with a scanning electron microscope (SEM: S-4700: trade name, manufactured by Hitachi, Ltd.) for 100 views. If particles of plural kinds of external additives have been externally added to the toner particles, mapping is conducted at an accelerating voltage of 20 kV using an energy dispersion-type X-ray analyzer [EMAX model 6923 H: trade name, manufactured by HORIBA, Ltd.] mounted on an electron microscope [SEM: S4700: trade name, manufactured by Hitachi, Ltd.] so as to differentiate the external particles of different kinds. The particle diameter of each particle is obtained as the average value of the major axis length and the minor axis length, and an arithmetic mean value of the particle diameters for the 1000 particles is used as the number average particle diameter of the external additive.

The number average particle diameter of the external additive A particles is from 7 nm to 200 nm. When the number average particle diameter of the external additive A particles is from 7 nm to 200 nm, the external additive A particles under the scraping stress moves on the surfaces of the external additive B particles, whereby microvibration occurs. The number average particle diameter of the external additive A particles is preferably from 10 nm to 40 nm (or from about 10 nm to about 40 nm), and more preferably from 15 nm to 25 nm (or from about 15 nm to about 25 nm).

The number average particle diameter of the external additive B particles is from 30 un to 4000 nm. When the number average particle diameter of the external additive B particles is from 30 nm to 4000 nm, the external additive A particles under the scraping stress move on the surfaces of the external additive B particles, whereby microvibration occurs. The number average particle diameter of the external additive B particles is preferably from 40 nm to 400 nm (or from about 40 nm to about 400 nm), and more preferably from about 100 nm to about 200 nm.

The particle diameter ratio between the external additives according to the exemplary embodiment is in a range of from 2 to 20. When the particle diameter ratio between the external additives according to the exemplary embodiment is in a range of from 2 to 20, the external additive A particles under the scraping stress move on the surfaces of the external additive B particles, whereby microvibration occurs (when the difference in particle diameter is in a certain range, the surfaces of the external additive B particles may be considered as flat surfaces in comparison with the size of the external additive A particles).

The particle diameter ratio between the external additive particles according to the exemplary embodiment is preferably in a range of from 4 to 16, and more preferably in a range of from 6 to 10.

In the toner according to the exemplary embodiment, the particles of one of the external additive A or the external additive B are particles in which a core material is covered with an organic material containing hydrogen and nitrogen, and the particles of the other one of the external additive A or the external additive B are $SiO_2$ particles.

The organic material containing nitrogen has positive charging property supposedly due to the strong negative charging property of $SiO_2$; therefore, the external additive A particles and the external additive B particles are considered to effectively form electrostatic aggregate at a minute region at the nip portion between the cleaning blade and the surface of the photoreceptor.

Organic materials containing nitrogen has a positive charging property. Although tests are conducted in which $SiO_2$ particles are combined with positively charging materials (such as a resin not containing nitrogen) other than the organic materials containing nitrogen, the effects according to the exemplary embodiment are not obtained.

It is considered that electrostatic aggregation between N and $SiO_2$ is effective at the nip portion, at which the distance between particles is small and a strong scraping stress is applied.

In the external additive particles in which a core material is covered with an organic material containing hydrogen and nitrogen, since the organic material of the coating layer contains nitrogen and hydrogen, an intermolecular hydrogen bond is formed between nitrogen and hydrogen. Specifically, when an element having light electronegativity (a negatively charged element) such as nitrogen interacts with hydrogen, hydrogen is strongly charged positively to form a hydrogen bond between nitrogen and hydrogen. Since the hydrogen bond has particularly strong dipole-dipole interaction, a strong bond is formed between molecules.

In the next place, the external additive particles in which a core material is covered with an organic material containing hydrogen and nitrogen will be described in more detail.

—Organic Material Containing Hydrogen and Nitrogen—

Examples of the organic material containing hydrogen and nitrogen (hereinafter sometimes referred to as "organic material") include an amino resin, an amino-modified silicone oil, an amino-modified silane coupling agent, an amino-modified titanate coupling agent, an amino-modified aluminate coupling agent, an amino-modified fatty acid, an amino-modified fatty acid metal salt, an ester of an amino-modified fatty acid, and a rosin acid. The organic material containing hydrogen and nitrogen may be used singly or in combination of two or more thereof. It is possible to additionally use one organic material containing neither hydrogen nor nitrogen or additionally use two or more organic materials containing neither hydrogen nor nitrogen.

Examples of the organic material containing hydrogen and nitrogen include N-(2-aminoethyl)-3-aminopropyltrimethoxysilane, N-(2-aminoethyl)-3-aminopropylmethyldimethoxysilane, N-(2-aminoethyl)-3-aminopropyldimethylmethoxysilane, N-(2-aminoethyl)-3-aminopropyltriethoxysilane, N-(2-aminoethyl)-3-aminopropylmethyldiethoxysilane, N-(2-aminoethyl)-3-aminopropyldimethylethoxysilane, N-trimethoxysilylpropyldiaminobiphenyl, N-trimethoxysilylpropyldiaminodiphenylmethane, (aminoethylaminomethyl)phenethyltrimethoxysilane, N-[2-(vinylbenzylamino)ethyl]-3-aminopropyltrimethoxysilane, N,N'-bis[3-(trimethoxysilyl)propyl]ethylenediamine, N,N'-bis[3-(trimethoxysilyl)propyl]ethylenediamine, N,N'-bis[3-(trimethoxysilyl)propyl]diaminopropane, N,N'-bis[3-(trimethoxysilyl)propyl]diaminohexane, N-trimethoxysilylpropyldiethylenetriamine, N,N'-bis[3-(trimethoxysilyl)propyl]diethylenetriamine, N-trimethoxysilylpropyldiethylenetriamine, and N-2-aminoethylaminopropyldimethylethoxysilane.

—Core Material—

The core material may be an inorganic particle, and may be selected from known inorganic particles usable as an external additive. Examples of the inorganic particles include, specifically, particles of any of the following: carbon black, silica, titanium oxide, alumina, zinc oxide, cerium oxide, strontium titanate, calcium carbonate, or a complex oxide of two of, or two or more of, the above materials. The method of producing the inorganic particle is not particularly limited, and may be a wet process such as a sol-gel process, for the following reason.

The content of nitrogen atoms in the external additive particles having a core material covered with an organic material containing hydrogen and nitrogen may be from 0.5 atom % to 3 atom % when measured by X-ray photoelectron spectroscopy under Ar etching with an Ar etching time of from 0 to 100 seconds.

The Ar etching at the time of measurement by X-ray photoelectron spectroscopy is performed in order to check the distribution of nitrogen atoms in the thickness direction of the coating layer.

Measurement by X-ray photoelectron spectroscopy was conducted by use of an X-ray photoelectron spectrometer (JPS-9000MX. trade name, manufactured by JEOL Ltd.), under the following conditions: The measurement intensity was 10.0 kV, the emission current was 20 mA, the X-ray source was a MgKa, the Ar gas pressure was $3\times10^{-2}$ Pa, and the accelerating voltage was 400 V at 6 to 7 mA. In the external additive for toner according to the exemplary embodiment of the invention, the nitrogen content is within the specified range when measured with any Ar etching time within the range of from 0 sec to 100 sec.

When the content of nitrogen atoms is from 0.5 atom % to 3 atom % with an Ar etching time of 0 sec to 100 sec (i.e., within a certain depth in the thickness direction of the coating film), the coating layer contains a certain amount of nitrogen atoms (providing a certain probability of contact with the nitrogen atoms) and has a certain thickness (abundance of nitrogen atoms on the top surface is made uniform by forming hydrogen bonds). As a result, electrostatic aggregates with $SiO_2$ particles are formed more effectively, leading to excellent temporal stability. When the content of nitrogen atoms is less than 0.5 atom %, the amount of nitrogen atoms at the surface of the external additive is small, so that electrostatic aggregates with $SiO_2$ particles may be difficult to form. When the content of nitrogen atoms is more than 3 atom %, the amount of nitrogen atoms in the coating layer is large and electrostatic repulsion between the nitrogen atoms occurs, so that the coating layer of the external additive particles may be brittle and electrostatic aggregates with $SiO_2$ particles may be difficult to form. The content of nitrogen atoms is preferably in the range of from 1.0 atom % to 2.5 atom % (or from about 1.0 atom % to about 2.5 atom %), and more preferably in the range of from 1.5 atom % to 2.0 atom % (or from about 1.5 mass % to about 2.0 atom %).

Further, in the external additive in which a core material is covered with an organic material containing hydrogen and nitrogen, nitrogen atoms at a content of from 0.5 atom % to 3 atom % may be observed in the coating layer even with an Ar etching time of 100 sec. Therefore, the thickness of the coating layer is larger than the thickness of the coating layer of a conventional external additive particle obtained by providing a coating layer on the surface of an inorganic particle. When an organic material containing hydrogen and nitrogen (typically an amnino-modified silicone oil) is used to form a coating layer on an inorganic particle in a manner similar to the preparation of a conventional external additive particle, nitrogen is not detected when the Ar etching time reaches 100 sec (indicating that, with an Ar etching time of 100 sec, the etching penetrates through the coating layer and is performed on the inorganic particle). This demonstrates that the thickness of the coating layer in the exemplary embodiment of the invention is larger than the thickness of the coating layer of a conventional external additive particle obtained by providing a coating layer on the surface of an inorganic particle.

If the maximum value of Ar etching time with which the measured content of nitrogen atoms in the coating layer falls within a range of from 0.5 atom % to 3 atom % is less than 100 sec. the thickness of the coating layer is thin, so that the coating layer peels to expose the surface of the inorganic particle while image formation is performed for a long time. Accordingly, aggregates between the external additive particles are formed and cause damages on the surface of the electrostatic latent image holder.

The maximum value of the Ar etching time with which the measured content of nitrogen atoms in the coating layer is within the range of from 0.5 atom % to 3 atom % is preferably at least 120 sec, and more preferably at least 140 sec. The content of nitrogen atoms may be kept within the range of from 0.5 atom % to 3 atom % (or from about 0.5 atom % to about 3 atom %) from the surface of the coating layer to a neighborhood of the interface between the coating layer and the inorganic particle.

—Method of Forming Coating Layer—

The coating layer formed on the surface of the core material may have a large film thickness and a great strength. In this light, the following points are important:

(1) improve reactivity between the surface of the core material and the coating material;

(2) increase the amount of the coating material chemically adhered to the surface of the core material and the amount of the coating material physically adsorbed on the surface of the core material; and (3) strengthen the interaction between molecules of the coating material in the coating layer.

(1) The method for improving the reactivity between the surface of the core material and the coating material may be, for example, a method of performing plasma processing on the surface of the core material to increase reaction sites (i.e., hydroxyl group) that can react with the coating material. When plasma processing is performed, contaminants adhering to the surface of the core material may be removed, and adhesion between the surface of the core material and the coating layer may be further improved; further, adhesion between the surface of the core material and the coating layer may be improved even when using a core material prepared by a dry process, which naturally has only a small number of reaction sites on the surface.

However, since reaction sites increase, for example, the plasma processing, if used alone, may create an insufficient effect in inhibition of aggregation of the core material caused by damage or collapse of the coating layer. This is because the increased reaction sites naturally causes more mechanical stress and peeling of the coating layer, which lead to easy aggregation. However, in the external additive in which a core material is covered with an organic material containing hydrogen and nitrogen, the coating layer provided on the surface of the core material is not easily peeled off even under a mechanical stress; as a result, aggregation may be inhibited.

(2) In order to increase the amount of the coating material chemically adhered to the surface of the core material, for example, the formation of the coating layer may be conducted in a condition in which aggregation between molecules of the coating material is inhibited while reaction between the coating material and the surface of the core material is promoted. Examples of the method for achieving such a condition include, specifically, decreasing the number of reactive groups, such as an alkoxy group, in the coating material; using a coating material at low concentration at reaction; using a low-molecular-weight solvent at reaction; and conducting reaction under an acid condition. Examples of the method for increasing the amount of the coating material physically adsorbed on the surface of the core material include using, as a coating material, an amino-modified silicone oil, an amino-modified silane coupling agent, or an amino resin, each of which has a long molecular chain and/or a branch structure; increasing the number of reactive groups, such as an alkoxy group, in the coating material; using a coating material at high concentration at reaction; using a high-molecular-weight solvent at reaction; and conducting reaction under an alkaline condition. These measures facilitate physical entanglement between the coating material molecules.

(3) Examples of the method for strengthening the interaction between molecules of the coating material in the coating layer include, as already described, forming a hydrogen bond between a hydrogen atom and a nitrogen atom; and randomizing the orientation of the molecules of the coating material in the coating layer. From this viewpoint, the amount of hydrogen atoms and nitrogen atoms contained in the coating layer may be increased. In order to increase the amount of hydrogen atoms and nitrogen atoms, for example, a coating material containing a large amount of hydrogen atoms and nitrogen atoms per molecule may be used. Examples of the coating material include N,N'-bis[3-(trimethoxysilyl)propyl]diethylenetriamine. N-trimethoxysilylpropyldiethylenetriamine, and N-2-aminoethylaminopropylmetlhyldimethoxysilane.

$SiO_2$ particles are also added as another external additive. The method for producing the $SiO_2$ particles is not particularly limited, and may be a wet process such as a sol-gel process. In this case, since there are many hydroxyl groups on the surface of the inorganic particle, the organic material is naturally peeled off under a mechanical stress, thus easily causing aggregation. However, in the external additive in which a core material is covered with an organic material containing hydrogen and nitrogen, the organic material provided on the surface of the inorganic particle is not easily peeled off even under a mechanical stress, so that aggregation is inhibited.

Regarding the above-described external additive A and external additive B, a particle of the external additive A easily rolls on the surface of a particle of the external additive B. The particle of the external additive A more easily rolls on the particle of the external additive B when the external additive B, having a larger particle diameter, is closer to a sphere, and still more easily rolls on the particle of the external additive B when the particle of the external additive A and the particle of the external additive B are respectively closer to spheres, because the contact point less chances from moment to moment). The average sphericity of the external additive B is preferably at least 0.6 (or at least about 0.6), and more preferably at least 0.8 (or at least about 0.8). Further, it is preferable that the average sphericity of each of the external additive A and the external additive B is at least 0.6, and is more preferably at least 0.8.

Wadell's true sphericity $\Psi$ is used as the average sphericity of the external additive, and the sphericity is obtained by the following formula.

Sphericity=(the surface area of a sphere having the same volume as that of the actual particle)/(the surface area of the actual particle)

In the above formula, "the surface area of a sphere having the same volume as that of the actual particle" can be obtained by an arithmetic calculation from the number average particle diameter of the external additive. "The surface area of the actual particle" is the BET specific surface area measured by a specific surface area measuring instrument (MACSORB HM model-1201: trade name, manufactured by Mountech Co., Ltd.) under the following conditions:

Deaeration condition: 30° C. 120 min;

Measurement method: Flow method (BET one-point method);

Carrier gas: helium;

Adsorbate: nitrogen; and

Equilibrium relative pressure (P/P0): 0.3.

When the amounts of the external additive A and the external additive B to be accumulated in the blade nip portion are small, expected effects according to the exemplary embodiment may not be obtained. The external addition amount of the external additive A with respect to 100 parts by weight of the toner particles is preferably from 0.1 parts by weight to 5.0 parts by weight (or from about 0.1 parts by weight to about 5.0 parts by weight), and more preferably from 0.5 parts by weight to 2.0 parts by weight (or from about 0.5 parts by weight to about 2.0 parts by weight).

The external addition amount of the external additive B with respect to 100 parts by weight of the toner particles is preferably from 0.1 parts by weight to 5.0 parts by weight (or from about 0.1 parts by weight to about 5.0 parts by weight), and more preferably from 0.1 parts by weight to 2.0 parts by weight (or from about 0.1 parts by weight to about 2.0 parts by weight).

—Toner Particles—

Toner particles according to the exemplary embodiment may include at least a binder resin and a colorant. However, when invisibility is required such as printing of encrypted information, the toner particles may be toner particles not containing a colorant. The production method of the toner particles used in the exemplary embodiment is not limited, and known production methods may be used. A wet process is preferable in consideration of ease in formation of aggregates of particles of the external additive A and particles of the external additive B.

Examples of the production method of the toner particles include, a kneading and pulverizing process in which a binder resin, a colorant, and, optionally, at least one other substance such as a release agent or a charge control agent, are kneaded, pulverized and classified; a process in which particles obtained by the kneading and pulverizing method are deformed by a mechanical impact force or a thermal energy; an emulsion-polymerization aggregation process in which a dispersion liquid formed by emulsion polymerization of a polymerizable monomer of a binder resin and a dispersion liquid or dispersion liquids of a colorant, a release agent, and, optionally, at least one other substance such as a charge control agent, are mixed, aggregated, and thermally fused to form toner particles; a suspension polymerization process in which a solution of a polymerizable monomer for forming a binder resin, a colorant, a release agent, and, optionally, at least one other substance such as a charge control agent, are suspended in an aqueous medium and polymerized; and a dissolution suspension process in which a solution of a binder resin, a colorant, a release agent, and, optionally, at least one other substance such as a charge control agent, are suspended in an aqueous medium and toner particles are formed therefrom. Each of the above production methods may further include adhering aggregated particles to the obtained toner particles as cores, and heating and fusing the aggregated particles to form a core-shell structure.

—Binder Resin—

Examples of the usable binder resin include homopolymers and copolymers of the following materials: styrenes such as styrene and chlorostyrene; monoolefins such as ethylene, propylene, butylene and isoprene; vinyl esters such as vinyl acetate, vinyl propionate, vinyl benzoate and vinyl lactate; α-methylene aliphatic monocarboxylic acid esters such as methyl acrylate, ethyl acrylate, butyl acrylate, dodecyl acrylate, octyl acrylate, phenyl acrylate, methyl methacrylate, ethyl methacrylate, butyl methacrylate and dodecyl methacrylate; vinyl ethers such as vinyl methyl ether, vinyl ethyl ether and vinyl butyl ether; and vinyl ketones such as vinyl methyl ketone, vinyl hexyl ketone and vinyl isopropenyl ketone. Particularly representative examples of the binder resin include polystyrene, a styrene-alkyl acrylate copolymer, a styrene-alkyl methacrylate copolymer, a styrene-acrylonitrile copolymer, a styrene-butadiene copolymer, a styrene-maleic anhydride copolymer, polyethylene and polypropylene. Further examples thereof include polyester, polyurethane, an epoxy resin, a silicone resin, polyamide, modified rosin and a paraffin wax.

—Colorant—

Typical examples of the colorant to be used for the toner particles include a magnetic powder such as powder of magnetite or ferrite; Carbon black, Aniline Blue, Carcoil Blue, Chrome Yellow, Ultramarine Blue, DuPont Oil Red, Quinoline Yellow, Methylene Blue Chloride, Phthalocyanine Blue, Malachite Green Oxalate, Lamp Black, Rose Bengal, C.I. Pigment Red 48:1, C.I. Pigment Red 122, C.I. Pigment Red 57:1, C.I. Pigment Yellow 97, C.I. Pigment Yellow 17, C.I. Pigment Blue 15:1, and C.I. Pigment Blue 15:3.

—Release Agent—

A release agent may be added to the toner particles. Typical examples of the release agent include a low-molecular-weight polyethylene, a low-molecular-weight polypropylene, a Fischer-Tropsch wax, a montan wax, a carnauba wax, a rice wax, and a candelilla wax.

—Other Internal Additives—

A charge control agent may be added to the toner particles as necessary. A known charge control agent may be used. The charge control agent may be, for example, an azo-series metal complex compound, a metal complex compound of salicylic acid or a resin-type charge control agent containing a polar group. When a toner is produced by a wet method, it is preferable to use materials hardly soluble in water, from the viewpoints of controlling ionic strength and reducing waste-water contamination.

The toner according to the exemplary embodiment may be either a magnetic toner containing a magnetic material inside thereof or a non-magnetic toner containing no magnetic material.

—Other External Additives—

The toner according to the exemplary embodiment may include, in addition to the already-described external additive A and external additive B, at least one other conventional external additive, as necessary.

For example, an external additive including known inorganic particles and/or resin particles may be externally added to the toner particles with the purpose of improving, for example, charging property, powder property, transfer property, and cleaning property, and examples thereof include inorganic particles, a charge control agent, a lubricant, an abrasive, and a cleaning aid.

—Developer for Developing an Electrostatic Image

A developer for developing an electrostatic image according to the exemplary embodiment (hereinafter sometimes referred to as "developer") includes at least the toner according to the exemplary embodiment. A one-component developer for developing an electrostatic image may be obtained by using the toner according to the exemplary embodiment singly, and a two-component developer for developing an electrostatic image may be obtained by using a combination of the toner and a carrier.

Carriers usable in the binary-component system developer for developing an electrostatic image are not particularly limited. For example, a carrier having a resin coating layer on the surface of the core material may be used in which the resin coating layer contains an electroconductive material dispersed in a matrix resin.

Examples of the matrix resin include, but are not limited to, polyethylene, polypropylene, polystyrene, polyacrylonitrile, polyvinyl acetate, polyvinyl alcohol, polyvinyl butyral, polyvinyl chloride, polyvinyl carbazole, polyvinyl ether, polyvinyl ketone, a vinyl chloride-vinyl acetate copolymer, a styrene-acrylic acid copolymer, a straight silicone resin formed by organosiloxane bonds or a modified product thereof, a fluorinated resin, polyester, polyurethane, polycarbonate, a phenol resin, an amino resin, a melamine resin, a benzoguanamine resin, a urea resin, an amide resin, and an epoxy resin. Examples of the electroconductive material include, but are not limited to, metals such as gold, silver or copper; titanium oxide, zinc oxide, barium sulfate, aluminum borate, potassium titanate, tin oxide, and carbon black.

The content of the electroconductive material is preferably from 1 parts by weight to 50 parts by weight, and more preferably from 3 parts by weight to 20 parts by weight, with respect to 100 parts by weight of the matrix resin.

Examples of the core material of the carrier include magnetic metals such as iron, nickel or cobalt; magnetic oxides such as ferrite or magnetite; and glass beads. Magnetic materials are preferable for adjusting volume resistivity when a magnetic brush process is used.

The average particle diameter of the core material is generally from 10 μm to 500 μm and preferably from 30 μm to 100 μm.

Examples of the method of forming the resin coating layer on the carrier core material include a dip process in which the carrier core material is dipped in a coating layer forming solution containing a matrix resin, an electroconductive material, and a solvent; a spray process in which the coating layer forming solution is sprayed onto the surface of the carrier core material; a fluid bed process in which the coating layer forming solution is sprayed to the carrier core material while the carrier core material is floated by a flowing air; and a kneader coater process in which the carrier core material and the coating layer forming solution are mixed in a kneader coater and then the solvent is removed therefrom.

The solvent to be used in the coating layer forming solution is not particularly limited as long as the solvent dissolves the matrix resin; the solvent is, for example, an aromatic hydrocarbon such as toluene or xylene; a ketone such as acetone or methyl ethyl ketone; or an ether such as tetrahydrofuran or dioxane.

The average thickness of the resin coating layer is generally from 0.1 μm to 10 μm. However, the average thickness of the resin coating layer in the exemplary embodiment is preferably in the range of from 0.5 μm to 3 μm in order to stabilize the volume resistivity of the carrier over time.

The volume resistivity of the carrier formed as described above may be from $10^6$ to $10^{14}$ Ωcm in the range of from $10^3$ to $10^4$ V/cm, which range corresponds to a common development contrast potential range, from the viewpoint of achieving high image quality. When the volume resistivity of the carrier is lower than $10^6$ Ωcm, reproducibility of thin lines is decreased, and toner fogging tends to occur in the background due to charge injection. On the other hand, when the volume resistivity of the carrier is higher than $10^{14}$ Ωcm, reproducibility of solid black and halftone is decreased, and the amount of the carrier to be transferred to the electrostatic latent image holder increases, which may lead to damage of the electrostatic latent image holder.

<Image Forming Apparatus>

In the next place, an image forming apparatus according to an exemplary embodiment of the invention using the toner for developing an electrostatic image according to the above-described exemplary embodiment of the invention will be described.

An image forming apparatus according to an exemplary embodiment of the invention includes: an electrostatic latent image holder; a developing unit that forms a toner image by developing an electrostatic latent image formed on the electrostatic latent image holder using a developer; a transfer unit that transfers the toner image formed on the electrostatic latent image holder onto a transfer receiving material; a fusing unit that fuses the toner image transferred onto the transfer receiving material; a cleaning unit that cleans a transfer residual toner by scraping the electrostatic latent image holder with a cleaning blade; and a transfer residual toner carrying unit that carries the transfer residual toner collected by the cleaning unit; wherein the developer is the developer according to the exemplary embodiment for developing an electrostatic image.

In the image forming apparatus, for example, a portion which contains the developing unit may have a cartridge structure (a process cartridge) that is attachable to and detachable from an image forming apparatus main body. The process cartridge is preferably a process cartridge according to an exemplary embodiment of the invention, which has at least a developer holder and contains the developer according to the exemplary embodiment for developing an electrostatic image.

An example of the image forming apparatus according to the exemplary embodiment of the invention is described below; however, this example should not be construed as limiting the invention.

FIG. 1 is a schematic configuration diagram showing a quadruple tandem system full-color image forming apparatus. The image forming apparatus shown in FIG. 1 includes first to fourth electrophotographic image forming units 10Y, 10M, 10C, and 10K (image forming sections) that output images of the respective colors of yellow (Y), magenta (M), cyan (C) and black (K) based on color-separated image data. The image forming units (hereinafter, simply referred to as "units") 10Y, 10M, 10C, and 10K are disposed in parallel and are separated with a predetermined distance from each other in the horizontal direction. The units 10Y, 10M, 10C, and 10K may be process cartridges that are attachable to and detachable from the image forming apparatus main body.

An intermediate transfer belt 20 as an intermediate transfer member is provided at the upper side of the units 10Y, 10M, 10C, and 10K in the figure, to be extending through the respective units. Primary transfer rollers 5Y, 5M, 5C, and 5K are disposed at the inner side of the intermediate transfer belt 20, and oppose photoreceptors 1Y, 1M, 1C, and 1K, respectively. The intermediate transfer belt 20 is wound around a driving roller 22 and a support roller 24 which are separately disposed at a distance from each other in the direction from right to left in the figure and which are in contact with the inner surface of the intermediate transfer belt 20. The intermediate transfer belt 20 is configured to run in the direction from the first unit 10Y toward the fourth unit 10K. The support roller 24 is pressed by a spring or the like (not shown in the figure) in the direction away from the driving roller 22, so that a predetermined tension is applied to the intermediate transfer belt 20 wound around the support roller 24 and the driving roller 22. Further, an intermediate transfer member cleaning device 30 is disposed at the photoreceptor side of the intermediate transfer belt 20, so that the intermediate transfer member cleaning device 30 faces the driving roller 22. Recording sheets P are taken out one by one, and each recording sheet P is conveyed to a nip portion between the support roller 24 and a secondary transfer roller 26, at which the toner images formed on the intermediate transfer belt 20 is transferred onto the recording sheet P. The recording sheet P is then conveyed to a fixing unit 28, at which the toner image is fused. Then, the recording sheet P is discharged from the image forming apparatus.

Toners of four colors of yellow, magenta, cyan and black, which are respectively contained in toner cartridges 8Y, 8M, 8C and 8K, can be supplied to developing devices (developing unit) 4Y, 4M, 4C and 4K of the units 10Y, 10M, 10C, and 10K, respectively. Charging rollers 2Y, 2M, 2C, and 2K charges the photoreceptors 1Y, 1M, 1C, and 1K, respectively, to a predetermined voltage. Laser beams 3Y, 3M, 3C, and 3K are irradiated from an exposure device 3 to the photoreceptors 1Y, 1M, 1C, and 1K, so as to form electrostatic images on the respective photoreceptors.

Further, photoreceptor cleaning devices 6Y, 6M, 6C, and 6K are provided with a transfer residual toner carrying unit (not shown in the figure) for carrying transfer residual toner collected by the photoreceptor cleaning devices 6Y, 6M, 6C, and 6K.

The residual toner on the photoreceptors 1Y, 1M, 1C, and 1K is cleaned off and collected by the cleaning devices 6Y, 6M, 6C, and 6K. In the process of cleaning by the cleaning devices 6Y, 6M, 6C, and 6K and carrying by the transfer residual toner carrying unit, the above-described effects according to the exemplary embodiment are exerted.

In the image forming apparatus according to the exemplary embodiment, a cleaning blade is used as a cleaning unit.

The cleaning blade is not particularly limited as long as the cleaning blade is a known cleaning blade. From the viewpoint of, for example, maintaining the cleaning property over a long time, the cleaning blade is preferably formed of an elastic member having, at 25° C., a JIS-A rubber hardness of from 50 degrees to 100 degrees, a 300% modulus of from 8 MPa to 55 MPa, and an impact resilience of from 4% to 85%.

The method of measuring the impact resilience is, specifically, compliant with a Lubke impact resilience test according to the JIS K6255 impact resilience test method for vulcanized rubbers and thermoplastic rubbers. When performing the impact resilience measurement, the sample to be measured may be left at the temperature for measurement (for example, at 25° C., when measuring impact resilience at 25° C.) for sufficient time in advance, so that the sample to be measured becomes to have the temperature for measurement.

The material of the cleaning blade is not particularly limited, and various elastic materials may be used. Examples of the elastic materials include, specifically, elastomers such as a polyurethane elastomer, a silicone rubber, or a chloroprene rubber.

The polyurethane elastomer is, generally, a polyurethane synthesized through an addition reaction of isocyanate, polyol, and various hydrogen-containing compounds. The polyol component may be selected from a polyether-based polyol such as polypropylene glycol or polytetramethylene glycol, or a polyester-based polyol such as an adipate-based polyol, a polycaprolactam-based polyol, or a polycarbonate-based polyol. The isocyanate component may be selected from an aromatic polyisocyanate such as tolylene diisocyanate, 4,4'-diphenylmethane diisocyanate, polymethylene polyphenyl polyisocyanate, or toluene diisocyanate, or an aliphatic polyisocyanate such as hexamethylene diisocyanate, isophorone diisocyanate, xylylene diisocyanate, or dicyclohexylmethane diisocyanate. A urethane prepolymer is prepared from such an isocyanate component and such a polyol component. Then, a curing agent is added to the urethane prepolymer, the mixture is supplied into a predetermined mold and is cross-linked and cured, and then the cured material is aged at room temperature, whereby a polyurethane elastomer is produced. In general, as the curing agent, a dihydric alcohol such as 1,4-butanediol and a tri- or higher-hydric alcohol such as trimethylolpropane or pentaerythritol may be used in combination.

In the present specification, the term "rubber hardness" means the A-rubber hardness described in JIS K-6200 No. 3344 "hardness", and is hereinafter simply referred to as "rubber hardness". When the rubber hardness of the cleaning blade is less than 50 degrees, since the cleaning blade is soft and is likely to be worm the cleaning blade may fail to remove some of the toner particles, and various imaging disorders may be caused by the toner particles remaining on the surface of the electrostatic latent image holder. When the rubber hardness is over 100 degrees, since the cleaning blade is hard and causes abrasion of the electrostatic latent image holder, fogging may easily occur and ability to clean off the spherical toner may easily be deteriorated.

When the 300% modulus, which is a tensile stress when the elongation of the sample is 300%, is lower than 8 MPa, the blade edge may be deformed or easily tear, and may be vulnerable to chipping or abrasion, so that the blade may often fail to remove some of the toner particles. When the 300% modulus is over 55 MPa, the cleaning blade may be unable to follow the surface profile of the electrostatic latent image holder sufficiently since the surface profile may be followed by deformation of the cleaning blade; therefore, cleaning defects may be caused by poor contact between the cleaning blade and the electrostatic latent image holder.

Further, when the impact resilience described in JIS K-6255: 96 the impact resilience test method (hereinafter, simply referred to as "impact resilience") is lower than 4%, the cleaning blade has rigidity that is close to that of a rigid body, and reciprocating movement of the blade edge, with which the toner is scraped off, is difficult to occur, whereby the cleaning blade may often fail to remove some of the toner particles. When the impact resilience is over 85%, the blade may make noises due to vibration and the blade edge may lap.

The biting amount of the cleaning blade (the deformation amount of the cleaning blade pressed against the surface of the electrostatic latent image holder) cannot be generalized, but is preferably from 0.8 mm to 1.6 mm, and more preferably from 1.0 mm to 1.4 mm. Further, the contact angle of the cleaning blade with respect to the electrostatic latent image holder (an angle formed by the tangent to the surface of the electrostatic latent image holder and the cleaning blade) cannot be generalized, but is preferably from 18 degrees to 28 degrees.

There have been an attempt to set the pressing force of the cleaning blade against the electrostatic latent image holder to a value that is higher than that of conventional cleaning blades, in order to improve cleaning property of the surface of the electrostatic latent image holder. However, when the pressing force is increase, the stress caused by scraping of the electrostatic latent image holder with the cleaning blade is increased.

In particular, in a tandem system image forming apparatus, for example when printing many low-image-density images sequentially, such as when printing name cards, only a small amount of toner and external additive are newly supplied to the surface of the electrostatic latent image holder, and therefore the external additive and toner remaining at the blade nip portion are hardly replaced.

<Process Cartridge and Toner Cartridge>

Figure 2:
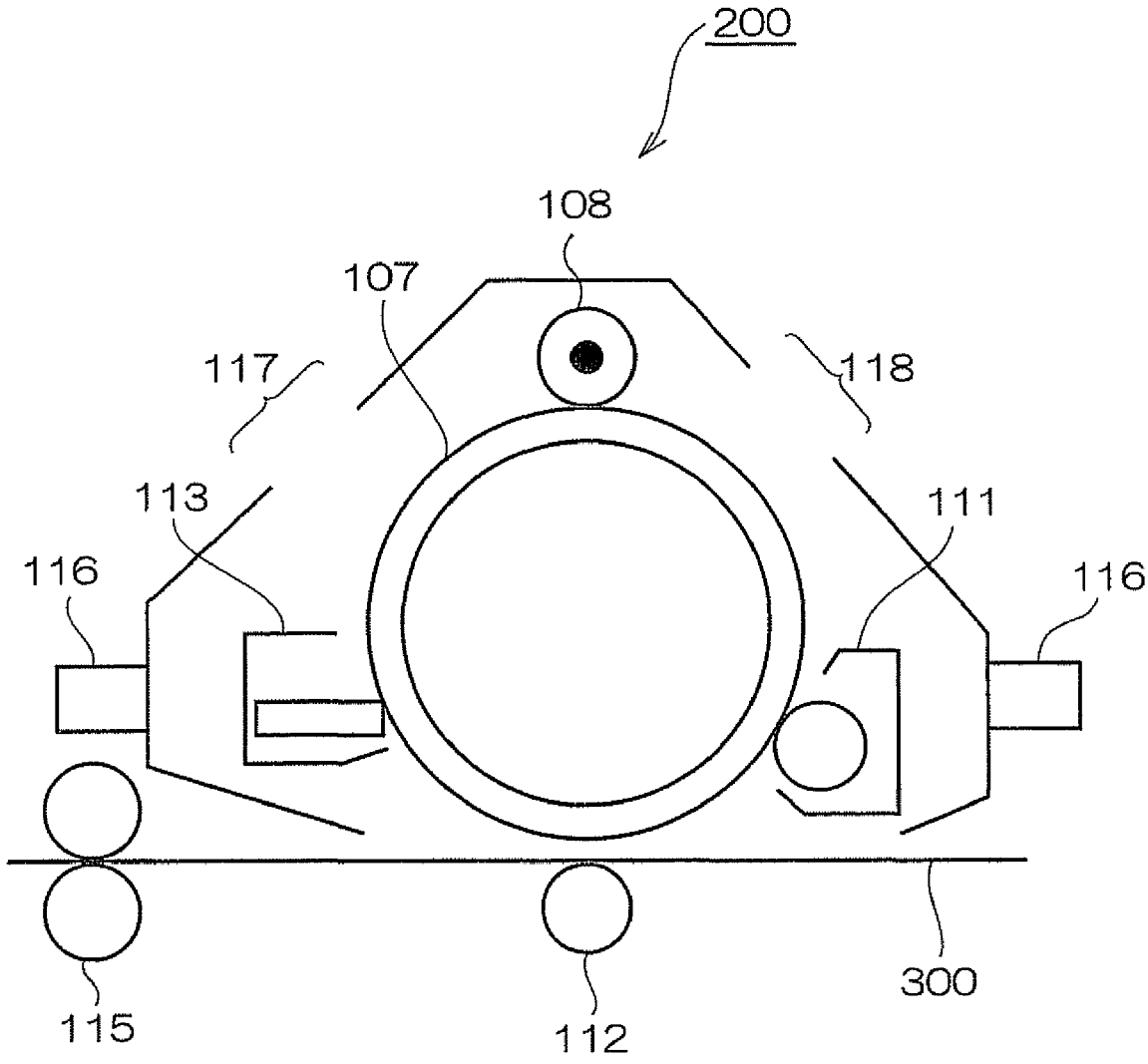
FIG. 2 is a schematic configuration diagram showing an example of a process cartridge according to an aspect of the invention.

FIG. 2 is a schematic configuration diagram showing an example of a process cartridge that contains an developer for developing an electrostatic image according to an exemplary embodiment of the invention. A process cartridge 200 includes a photoreceptor 107, a charging roller 108, a developing device 111, and a photoreceptor cleaning device (a cleaning unit) 113, an opening for exposure 118, and an opening for diselectrification and exposure 117, which are combined and integrated using an attachment rail 116.

The process cartridge 200 is attachable to and detachable from an image forming apparatus main body including a transferring device 112, a fusing device 115 and other components (not shown in the figure). The process cartridge 200 constitutes an image forming apparatus together with the image forming apparatus main body. A reference numeral 300 denotes recording paper.

The process cartridge 200 shown in FIG. 2 includes the charging device 108, the developing device 111, the cleaning device (cleaning unit) 113, the opening for exposure 118, and the opening for diselectrification and exposure 117; however, it is possible to select some or all of these devices and combined them to form a process cartridge. In addition to the photoreceptor 107, the process cartridge according to the exemplary embodiment may further include at least one selected from the charging device 108, the developing device 111, the cleaning device (cleaning unit) 113, the opening for exposure 118, or the opening for diselectrification and exposure 117. The process cartridge 200 may further include one or other elements not shown in the figure, such as a toner container or a toner carrying device that carries toner to be supplied from the toner container to the developing device 111.

In the next place, a toner cartridge according to the exemplary embodiment will be described. The toner cartridge according to the exemplary embodiment is attached to an image forming apparatus, and is attachable to and detachable from the image forming apparatus. The toner cartridge contains at least a toner to be supplied to the developing unit disposed inside the image forming apparatus, and the toner is the toner according to the exemplary embodiment described above. In this regard, the toner cartridge according to the exemplary embodiment is not limited as long as the toner cartridge contains at least the toner, and the toner cartridge may contain a developer composed of, for example, a toner and a carrier, depending on the mechanism of the image forming apparatus.

Therefore, in the image forming apparatus having a configuration in which the toner cartridge is attachable and detachable, it is easy to supply the toner according to the exemplary embodiment to the developing device by using the toner cartridge containing the toner according to the exemplary embodiment, whereby excellent cleaning performance may be maintained in continuous image formation.

The image forming apparatus shown in FIG. 1 is an image forming apparatus having a configuration in which toner cartridges 8Y, 8M, 8C and 8K are attachable and detachable, and developing devices 4Y, 4M, 4C and 4K are connected to the toner cartridges corresponding to the respective developing devices (colors) via toner supply tubes (not shown in the figure). When the amount of the toner contained in the toner cartridge becomes small, the toner cartridge can be replaced.

EXAMPLES

Hereinafter, the present invention will be described more specifically based on Examples. However, the following Examples should not be construed as limiting the invention. In the following description, "parts" denote "parts by weight" unless specified otherwise.

<Preparation of External Additives>

The following external additives (external additives (1) to (8) as external additives provided with surface layers, and external additive (I) to (VII) as external additives provided with surface layers) are prepared.

—Preparation of External Additive (1)—

Under a nitrogen atmosphere, 160 parts of ethanol, 5 parts of tetraethoxysilane, and 6 parts of water are put in a reaction container, and 5 parts of 20% aqueous ammonia is gradually added dropwise over 10 minutes while the liquid in the reaction container is stirred at 100 rpm. After stirring at 28° C. for 8 hours, the liquid is condensed by distillation using an evaporator until the liquid volume is halved. 400 parts of water is added to the liquid, and the liquid is adjusted to pH 4 with 0.3 M nitric acid, and then the product is precipitated by a centrifugal settler. After the supernatant solution is removed by decantation, the remaining liquid is lyophilized for approximately 60 hours in a freeze drier, whereby white powder of silica is obtained. The number average particle diameter of the silica is 16 nm.

After 100 parts of the above powder is put in a glass reaction container, inside the reaction container is depressurized to a vacuum degree of 0.05 Torr, and is rotated at 60 rpm for 6 hours. An argon gas is introduced in the container as an inert gas, and the pressure in the vacuum container is maintained at 0.7 Torr. A raw material for forming an organic covering layer containing hydrogen and nitrogen is set in a vapor source and is evaporated by laser heating, and the generated microparticles in a smoke-like state are delivered, together with an He—Ar mixed gas that has been introduced to an upper region of the vapor source, into a discharge plasma region that is already in a steady discharge state. In the discharge plasma region, an $O_2$ gas is introduced into the vicinity of a discharging electrode, and plasma is generated in this gas atmosphere ($O_2$ partial pressure: 1%). A plasma processing is conducted at an $O_2$ flow rate of 100 ml/min and an output of 100 W for 15 minutes (discharge gap: approx. 9 mm).

After stopping the plasma discharging, the supply of $O_2$ gas is stopped, and a mixed solution of 15 parts of 3-aminopropyltrimethoxysilane and 200 parts of toluene is introduced thereto, so that the plasma-processed microparticles are immersed in the reaction solution. After stirring at 60 rpm for 1 hour, the liquid is adjusted to pH 8 by adding a 1 M aqueous sodium hydroxide solution. Then, the liquid volume is decreased by distillation at reduced pressure to approximately one-third the initial volume. After the liquid is adjusted to pH 8 by adding a 1 M aqueous sodium hydroxide solution, a mixed solution of 30 parts of N-(2-aminoethyl)-3-aminopropyltrimethoxysilane and 100 parts of toluene is introduced thereto, and the resultant mixture is stirred at 60 rpm for 1 hour. Then, the liquid is further mixed for 3 hours while applying an ultrasonic wave.

Thereafter, the liquid containing the silica particles dispersed therein is distilled at reduced pressure using an evaporator. When the liquid volume is halved 100 parts of ethanol is added thereto. The resultant liquid is further distilled at reduced pressure using an evaporator, and then is heated at 150° C. for 3 hours. The obtained solidified product is pulverized, whereby an external additive (1) (average sphericity: 0.6) covered with an organic material containing hydrogen and nitrogen and having a number average particle diameter of 16 nm is obtained.

—Preparation of External Additive (2)—

An external additive (2) (average sphericity: 0.7) covered with an organic material containing hydrogen and nitrogen and having a number average particle diameter of 20 nm is obtained in the same manner as the preparation of the external additive (1), except that the stirring at 28° C. for 8 hours is replaced by stirring at 28° C. for 10 hours.

—Preparation of External Additive (3)—

An external additive (3) (average sphericity: 0.8) covered with an organic material containing hydrogen and nitrogen and having a number average particle diameter of 200 nm is obtained in the same manner as the preparation of the external additive (1), except that the white powder of silica is replaced by a gas phase $TiO_2$ having a number average particle diameter of 200 nm, and the 15 parts of 3-aminopropyltrimethoxysilane is replaced by 3 parts of 3-aminopropyltrimethoxysilane and 4 parts of N-(2-aminoethyl)-3-aminopropyltrimethoxysilane.

—Preparation of External Additive (4)—

An external additive (4) covered with an organic material containing hydrogen and nitrogen and having a number average particle diameter of 7 nm is obtained in the same manner as the preparation of the external additive (1), except that the white powder of silica is replaced by a gas phase $TiO_2$ having a number average particle diameter of 7 nm, and the 15 parts of 3-aminopropyltrimethoxysilane is replaced by 40 parts of 3-aminobutyltrimethoxysilane and 50 parts of N-(2-aminoethyl)-3-aminopropyitrimethoxysilane.

—Preparation of External Additive (5)—

Under a nitrogen atmosphere, 160 parts of ethanol, 15 parts of tetraethoxysilane, and 6 parts of water are put in a reaction container, and 10 parts of 20% aqueous ammonia is Gradually added dropwise over 10 minutes while the liquid in the reaction container is stirred at 100 rpm. After stirring at 30° C. for 5 hours, the liquid is condensed by distillation using an evaporator until the liquid volume is halved. 400 parts of water is added to the liquid, and the liquid is adjusted to pH 4 with 0.3 M nitric acid, and then the product is precipitated by a centrifugal settler. After the supernatant solution is removed by decantation, the remaining liquid is lyophilized for approximately 60 hours in a freeze drier, whereby white powder of silica is obtained. An external additive (5) covered with an organic material containing hydrogen and nitrogen and having a number average particle diameter of 205 nm is obtained in the same manner as the preparation of the external additive (1), except that this silica powder is used, 3 parts of 3-amninobutyltrimethoxysilane is used instead of the 15 parts of 3-aminopropyltrimethoxysilane, and 4 parts of N-(2-aminoethyl)-3-aminopropyltrimethoxysilane is used instead of the 30 parts of N-(2-aminoethyl)-3-aminopropyltrimethoxysilane.

—Preparation of External Additive (6)—

An external additive (6) covered with an organic material containing hydrogen and nitrogen and having a number average particle diameter of 5 nm is obtained in the same manner as the preparation of the external additive (1), except that a gas phase $SiO_2$ having a number average particle diameter of 5 nm is used, 60 parts of 3-aminobutyltrimethoxysilane is used instead of the 15 parts of 3-aminopropyltrimethoxysilane, and 70 parts of N-(2-aminoethyl)-3-aminopropyltrimethoxysilane is used instead of the 30 parts of N-(2-aminoethyl)-3-aminopropyltrimethoxysilane.

Preparation of External Additive (7)—

An external additive (7) covered with an organic material containing hydrogen and nitrogen and having a number average particle diameter of 12 nm is obtained in the same manner as the preparation of the external additive (1), except that a gas phase $SiO_2$ having a number average particle diameter of 12 nm is used and 40 parts of 3-aminobutyltrimethoxysilane is used instead of the 15 parts of 3-aminopropyltrimethoxysilane.

—Preparation of External Additive (I)—

Under a nitrogen atmosphere, 160 parts of ethanol, 12 parts of tetraethoxysilane, and 6 parts of water are put in a reaction container, and 10 parts of 20% aqueous ammonia is gradually added dropwise over 10 minutes while the liquid in the reaction container is stirred at 100 rpm. After stirring at 30° C. for 4 hours, the solution is condensed by distillation using an evaporator until the liquid volume is halved. 400 parts of water is added to the liquid, and the liquid is adjusted to pH 4 with 0.3 M nitric acid, and the product is precipitated by a centrifugal settler. After the supernatant solution is removed by decantation, the remaining solution is lyophilized for approximately 60 hours in a freeze drier, whereby white powder of silica is obtained. Thereafter, the silica powder is added to a solution obtained by diluting 10 parts of HMDS (hexamethyldisilazane) with 100 parts of toluene, and the solution is stirred for 1 hour while applying an ultrasonic wave. The solution containing the silica particles dispersed therein is distilled at reduced pressure using an evaporator. When the liquid volume is halved, 100 parts of ethanol is added thereto. The resultant liquid is further distilled at reduced pressure using an evaporator, and is heated at 120° C. for 3 hours. The obtained solid is pulverized, whereby an external additive (I) (average sphericity: 0.8) composed of $SiO_2$ and having a number average particle diameter of 150 nm is obtained.

—Preparation of External Additive (II)—

An external additive (II) (average sphericity: 0.8) composed of $SiO_2$ and having a number average particle diameter of 300 nm is obtained in the same manner as the preparation of the external additive (I), except that a gas phase $SiO_2$ having a number average particle diameter of 300 nm is used in place of the powder of silica.

—Preparation of External Additive (III)—

An external additive (III) composed of $SiO_2$ and having a number average particle diameter of 40 nm is obtained in the same manner as the preparation of the external additive (I), except that a gas phase $SiO_2$ having a number average particle diameter of 40 nm is used in place of the powder of silica, and 8 parts of dimethylsilicone oil is used instead of the HMDS.

—Preparation of External Additive (IV)—

An external additive (IV) composed of $SiO_2$ and having a number average particle diameter of 3000 nm is obtained in the same manner as the preparation of the external additive (I), except that a gas phase $SiO_2$ having a number average particle diameter of 3000 nm is used in place of the powder of silica, and 3 parts of HMDS is used in place of the 10 parts of HMDS.

—Preparation of External Additive (V)—

An external additive (V) composed of $SiO_2$ and having a number average particle diameter of 30 nm is obtained in the same manner as the preparation of the external additive (III), except that a gas phase $SiO_2$ having a number average particle diameter of 30 nm is used in place of the gas phase silica having a number average particle diameter of 40 nm.

—Preparation of External Additive (VI)—

An external additive (VI) composed of $SiO_2$ and having a number average particle diameter of 25 nm is obtained in the same manner as the preparation of the external additive (I), except that a gas phase $SiO_2$ having a number average particle diameter of 25 nm is used in place of the powder of silica.

—Preparation of External Additive (VII)—

An external additive (VII) composed of $TiO_2$ and having a number average particle diameter of 150 nm is obtained in the same manner as the preparation of the external additive (IV), except that a gas phase $TiO_2$ having a number average particle diameter of 150 nm is used in place of the gas phase silica having a number average particle diameter of 3000 nm.

Examples 1 to 8 and Comparative Examples 1 to 7

Preparation of Toner Particles

<Preparation of Resin Dispersion Liquid (1A)>

| | |
|---|---|
| Styrene | 370 parts |
| n-butyl acrylate | 30 parts |
| Acrylic acid | 8 parts |
| Dodecanethiol | 24 parts |
| Carbon tetrabromide | 4 parts |

A solution prepared by mixing and dissolving the above components is added into a flask containing 6 parts of a nonionic surfactant (NONIPOL 400: trade name, manufactured by Sanyo Chemical Industries Ltd.) and 10 parts of an anionic surfactant (NFOGEN SC: trade name, manufactured by Dai-ichi Kogyo Seiyaku Co., Ltd.) dissolved in 550 parts of ion-exchanged water, and is emulsified and dispersed. While slowly mixing the emulsion for 15 minutes, 50 parts of ion-exchanged water containing 4 parts of ammonium persulfate dissolved therein is added thereto. After nitrogen substitution, the content in the flask is heated to 70° C. in an oil bath while stirring the inside of the flask, and the emulsion polymerization is continued in this state for 5 hours. As a result, a resin particle dispersion liquid (1A) containing resin particles dispersed therein is obtained; the resin particles have a volume average particle diameter of 154 nm, Tg, of 58° C., and a weight average molecular weight Mw of 12000.

<Preparation of Resin Dispersion Liquid (2A)>

| | |
|---|---|
| Styrene | 280 parts |
| n-butyl acrylate | 120 parts |
| Acrylic acid | 9 parts |

A solution prepared by mixing and dissolving the above components is added into a flask containing 6 parts of an nonionic surfactant (NONIPOL 400: trade name, manufactured by Sanyo Chemical Industries Ltd.) and 12 parts of an anionic surfactant (NEOGEN SC: trade name, manufactured by Dai-ichi Kogyo Seiyak-u Co., Ltd.) dissolved in 550 parts of ion-exchanged water, and is emulsified and dispersed. While slowly mixing the emulsion for 10 minutes, 50 parts of ion-exchanged water containing 3 parts of ammonium persulfate dissolved therein is added thereto. After nitrogen substitution, the content in the flask is heated to 68° C. in an oil bath while stirring the inside of the flask, and the emulsion polymerization is continued in this state for 5 hours. As a result, a resin particle dispersion liquid (2A) containing resin particles dispersed therein is obtained; the resin particles have a volume average particle diameter of 105 nm, Tg of 54° C., and a weight average molecular weight Mw of 550000.

<Preparation of Colorant Dispersion Liquid>

| | |
|---|---|
| Carbon black (MOGUL L: trade name, manufactured by CABOT Corporation) | 50 parts |
| Nonionic surfactant (NONIPOL 400: trade name, manufactured by Sanyo Chemical Industries Ltd.) | 5 parts |
| Ion-exchanged water | 200 parts |

The above components are mixed and dissolved and then dispersed for 10 minutes with a homogenizer (ULTRA-TURRAX T50. trade name, manufactured by IKA), so that a colorant dispersion liquid containing colorant particles (carbon black) having an average particle diameter of 250 nm dispersed therein is prepared.

<Preparation of Release Agent Dispersion Liquid>

| | |
|---|---|
| Paraffin wax (HNP 0190 [melting point 85° C.]: trade name, manufactured by Nippon Seiro Co., Ltd.) | 50 parts |
| Cationic surfactant (SANIZOL B50: trade name, manufactured by Kao Corporation) | 5 parts |

The above components are dispersed for 10 minutes in a round stainless steel flask using a homogenizer (ULTRA-TURRAX T50: trade name, manufactured by IKA). Then the solution is further dispersed using a pressure discharge type homogenizer, so that a release agent dispersion liquid in which release agent particles having an average particle diameter of 550 nm are dispersed is prepared.

<Preparation of Toner Particles>

| | |
|---|---|
| Resin dispersion liquid (1A) | 125 parts |
| Resin dispersion liquid (2A) | 75 parts |
| Colorant dispersion liquid | 200 parts |
| Release agent dispersion liquid | 40 parts |
| Cationic surfactant (SANIZOL B50; trade name, manufactured by Kao Corporation) | 1.5 parts |

The above components are mixed and dispersed in a round stainless steel flask using a homogenizer (ULTRA-TURRAX T50: trade name, manufactured by IKA). Then, the content in the flask is heated to 50° C. in an oil bath for heating while stirring the inside of the flask. After maintaining the solution at 45° C. for 20 minutes, formation of aggregated particles having an average particle diameter of approximately 4.8 μm is confirmed when observed under an optical microscope. To the dispersion liquid, 58 parts of the resin dispersion liquid (1A) as a resin-containing particle dispersion liquid is slowly added. Thereafter, the temperature of the oil bath for heating is increased to 50° C. and is maintained at that temperature for 30 minutes. Formation of particles having an average particle diameter of approximately 5.5 μm is confirmed when observed under an optical microscope.

After 3 parts of an anionic surfactant (NEOGEN SC: trade name, manufactured by Dai-ichi Kogyo Seiyaku Co., Ltd.) is added to the particle dispersion liquid, the stainless steel flask is hermetically sealed. The dispersion liquid is heated to 105° C. while the dispersion liquid is stirred by using a magnetic seal, and the dispersion liquid is maintained at that temperature for 4.5 hours.

After cooling, the reaction product is filtered, sufficiently washed with ion-exchanged water, and dried, whereby toner particles having a volume average particle diameter D50v of 5.8 μm are obtained.

Thereafter. 100 parts by weight of the toner particles, 1 part by weight of external additive A shown in Table 1, and 1.5 parts by weight of external additive B shown in Table 1 are blended for 10 minutes using a Henschel mixer at a circumferential velocity of 32 m/sec. Then, coarse particles in the resultant mixture are removed using a 45 μm-mesh sieve, whereby toner particles to which the external additives have been externally added are obtained.

Preparation of Developer

| | |
|---|---|
| Ferrite particles (average particle diameter: 50 μm): | 100 parts |
| Toluene: | 14 parts |
| Styrene-methacrylate copolymer (copolymerization ratio by mole (styrene/methacrylate) = 90/10: Mw = 80000): | 2 parts |
| Carbon black (R330: trade name, manufactured by CABOT Corporation): | 0.2 parts |

First, the above components except the ferrite particles are stirred by a stirrer for 10 minutes, so that a coating dispersion liquid is prepared. Next, this coating liquid and the ferrite particles are put in a vacuum deaeration type kneader, and are stirred at 60° C. for 30 minutes. Then, while the mixture is heated, the mixture is depressurized, deaerated, and dried, whereby a carrier is obtained.

Then 100 parts of the carrier and 7 parts of the toner, to which the external additives have been externally added, are stirred at 40 rpm for 20 minutes using a V-blender, and the resultant mixture is sieved using a 177 μm-mesh sieve, whereby a developer is obtained.

<<Evaluation>>

Evaluations under the conditions described below are conducted using an image forming apparatus having a cleaning blade. This image forming apparatus is a modified tandem system image forming apparatus (DOCUPRINT 405/505: trade name, manufactured by Fuji Xerox Co. Ltd.) that is modified to have a discharged developer carrying path (transfer residual toner carrying unit, which is a bent portion disposed at a distance of 20 cm from the inlet of the discharging path and has a bore diameter of 1.5 mm, a length of 50 cm, a curvature of 0.2, and z curvature radius of 5 cm). The pressing force of the cleaning blade is set to 7.0 gf/mm$^2$.

<Evaluation Condition (1)>

A black image having an image density of 5% is formed on 1000 sheets of A4-sized recording paper in a low temperature and low humidity environment (10° C., 20 RH %), and the image forming apparatus is left in a high temperature and high humidity environment (30° C., 80 RH %) for 36 hours for seasoning, and then the same image forming process as above is performed.

<Evaluation Condition (2)>

The developing device (developing machine) after image formation performed in the evaluation condition (1) is taken out, and idle operation of the developing device is performed under high temperature and high humidity for 1 hour by using the modified DOCUPRINT 405/505 (at the same rotation rate as that of DOCUPRINT 405/505: trade name, manufactured by Fuji Xerox Co., Ltd.). Further, the image forming apparatus is left in a high temperature and high humidity environment (30° C., 85 RH %) for 24 hours for seasoning, and is the used to perform a process of forming a black image having an image density of 1% on 10 sheets of A4-sized recording paper and leaving the image forming apparatus for 5 minutes; the process is repeated to sequentially form images on 5000 sheets, <Image Quality Evaluation>

First, the formed images and the machine status under each of the evaluation condition (1) and evaluation condition (2) are evaluated as follows:

Excellent: there is no clogging of the carrying path, no spout of the discharged developer from the cleaning member involved, and no image defect (band-like fog).

Slightly defective: although clogging of the carrying path and spout of the discharged developer from the cleaning member involved are observed, image defects (such as band-like fog) are not observed with the naked eyes.

Moderately defective: clogging of the carrying path and spout of the discharged developer from the cleaning member involved are observed, and slight image defects (such as band-like fog) are observed with the naked eyes.

Severely defective: clogging of the carrying path and spout of the discharged developer from the cleaning member involved are observed, and image defects (such as band-like fog) are clearly observed with the naked eyes.

Next, from the evaluation results under the evaluation condition (1) and evaluation condition (2), a comprehensive evaluation is conducted according to the following criteria. The results are shown in Table 1.

A: Excellent in both of the evaluation conditions (1) and (2).

B: Excellent in the evaluation condition (1), but slightly defective in the evaluation condition (2).

C: Excellent in the evaluation condition (1), but moderately defective in the evaluation condition (2).

D: Excellent in the evaluation condition (1), but severely defective in the evaluation condition (2).

E: Slightly defective in the evaluation condition (1).

F: Moderately defective in the evaluation condition (1).

G: Severely defective in the evaluation condition (1).

After the evaluations under the evaluation condition (1), SEM observation of the nip portion between the cleaning blade and the surface of the photoreceptor, and SEM observation of the discharged toner are conducted. The external additive A and the external additive B present at the blade nip portion are mixed with each other in Examples 1 to 8; however, the external additive A and the external additive B are somewhat separated from each other in Example 7. In contrast, in Comparative Examples 1 to 7, the particles having a smaller particle diameter among the external additive A and the external additive B are accumulated at a portion nearer to the cleaning blade edge, and the proportion of the particles having a larger particle diameter among the external additive A and the external additive B is increased as the distance from the cleaning blade edge increases. In Examples 1 to 8, particles of the external additives are hardly embedded in the surfaces of the discharged toner particles, and deformation of the toner particles and peeling of the surfaces of the toner particles are hardly observed. In contrast, in Comparative Examples 1 to 7, embedding of the external additive particles, deformation of the toner particles, and peeling of the surfaces of the toner particles are observed.

The evaluation results may be interpreted as follows. Since the particles of the external additive A have a large particle diameter in Comparative Example 1, the particles of the external additive A alone get into the contact portion at which the photoreceptor contacts the blade, whereby an aggregation-accumulation layer of the external additive A is formed. In Comparative Examples 2 and 3, since each of the particle diameters of the external additive A and the external additive B is small, replacement of the matter accumulated at the contact portion at which the photoreceptor contacts the blade is not facilitated. In Comparative Example 4, the coating layer on the surfaces of the particles of the external additive A is collapsed, and aggregates of the particles of the external additives A are formed. In Comparative Example 5, an effect of diminishing the stress from the scraping force is small. In Comparative Examples 6 and 7, since mild aggregates cannot be formed between a particle of the external additive A and a particle of the external additive B, particles of the external additive A and particles of the external additive B are accumulated, separately from each other, at the contact portion at which the photoreceptor contacts the blade.

TABLE 1

| | | Examples | | | | | | | |
|---|---|---|---|---|---|---|---|---|---|
| | | 1 | 2 | 3 | 4 | 5 | 6 | 7 | 8 |
| External Additive A | Type | (1) | (2) | III | (1) | (1) | (1) | (3) | (4) |
| | Details | Covered with organic material including | Covered with organic material including | $SiO_2$ | Covered with organic material including H, N | Covered with organic material including H, N | Covered with organic material including H, N | Covered with organic material including H, N | Covered with organic material including H, N |

TABLE 1-continued

| | | | | | | | | | |
|---|---|---|---|---|---|---|---|---|---|
| | | H, N | H, N | | | | | | |
| | Particle diameter (nm) | 16 | 20 | 40 | 16 | 16 | 16 | 200 | 7 |
| External Additive B | Type | I | I | (3) | I | II | III | IV | V |
| | Details | $SiO_2$ | $SiO_2$ | Covered with organic material including H, N | $SiO_2$ | $SiO_2$ | $SiO_2$ | $SiO_2$ | $SiO_2$ |
| | Particle diameter (nm) | 150 | 150 | 200 | 150 | 300 | 40 | 3000 | 30 |
| B/A | Particle diameter ratio | 9.4 | 7.5 | 5 | 9.4 | 18.8 | 2.5 | 15 | 4.3 |
| Formation of Organic Coating Including H and N | N atom content Maximum value | 2.0 | 2.0 | 2.0 | 2.0 | 2.0 | 2.0 | 2.2 | 2.0 |
| | N atom content Minimum value | 1.5 | 0.5 | 1.5 | 1.5 | 1.5 | 1.5 | 1.7 | 1.6 |
| | Ar etching time | 140 s | 120 s | 120 s | 110 s | 120 s | 120 s | 120 s | 120 s |
| Results | Comprehensive evaluation | A | B | B | D | C | C | C | C |

| | | Comparative Examples | | | | | | |
|---|---|---|---|---|---|---|---|---|
| | | 1 | 2 | 3 | 4 | 5 | 6 | 7 |
| External Additive A | Type | (5) | (6) | (4) | (7) | (1) | (1) | |
| | Details | Covered with organic material including H, N | Covered with organic material including H, N | Covered with organic material including H, N | Covered with organic material including H, N | Covered with organic material including H, N | Covered with organic material including H, N | Gas phase method ZnO (processed with HMDS) |
| | Particle diameter (nm) | 205 | 5 | 7 | 12 | 16 | 16 | 16 |
| External Additive B | Type | IV | V | VI | II | V | VII | I |
| | Details | $SiO_2$ | $SiO_2$ | $SiO_2$ | $SiO_2$ | $TiO_2$ | $TiO_2$ | $SiO_2$ |
| | Particle diameter (nm) | 3000 | 30 | 25 | 70 | 30 | 150 | 150 |
| B/A | Particle diameter ratio | 14.6 | 6 | 3.6 | 1.8 | 1.9 | 9.4 | 9.4 |
| Formation of Organic Coating Including H and N | N atom content Maximum Value | 1.8 | 1.8 | 1.8 | 2.1 | 2.2 | 2.0 | — |
| | N atom content Minimum Value | 0.8 | 1.0 | 1.0 | 1.5 | 1.5 | 1.5 | — |
| | Ar etching time | 120 s | 120 s | 120 s | 120 s | 120 s | 120 s | 50 s |
| Results | Comprehensive evaluation | E | E | E | F | E | G | G |

What is claimed is:

1. A toner for developing an electrostatic image, comprising a toner particle to which particles of an external additive A having a number average particle diameter of from about 7 nm to about 200 nm and particles of an external additive B having a number average particle diameter of from about 30 nm to about 4000 nm have been externally added;

a ratio of the number average particle diameter of the particles of the external additive B to the number average particle diameter of the particles of the external additive A being in a range of from about 2 to about 20;

the particles of one of the external additive A or the external additive B being particles having a core material covered with an organic material containing hydrogen and nitrogen;

the particles of the other one of the external additive A or the external additive B being $SiO_2$ particles;

the average sphericity of the particles of each of the external additive A and the external additive B being from about 0.6 to about 0.8;

the $SiO_2$ particles being treated with a hexamethyldisilazane or a dimethylsilicone; and the organic material containing hydrogen and nitrogen comprising at least one of an amino resin, an amino-modified silicone oil, an amino-modified silane coupling agent, an amino-modified titanate coupling agent, an amino-modified aluminate coupling agent, an amino-modified fatty acid, an amino-modified fatty acid metal salt, an ester of an amino-modified fatty acid, and a rosin acid.

2. The toner for developing an electrostatic image according to claim 1, wherein the number average particle diameter of the particles of the external additive A is from about 10 nm to about 40 nm.

3. The toner for developing an electrostatic image according to claim 1, wherein the number average particle diameter of the particles of the external additive A is from about 15 nm to about 25 nm.

4. The toner for developing an electrostatic image according to claim 1, wherein the number average particle diameter of the particles of the external additive B is from about 40 nm to about 400 nm.

5. The toner for developing an electrostatic image according to claim 1, wherein the number average particle diameter of the particles of the external additive B is from about 100 nm to about 200 nm.

6. The toner for developing an electrostatic image according to claim 1, wherein the amount of the external additive A externally added to 100 parts by weight of the toner particle is from about 0.1 parts by weight to about 5.0 parts by weight.

7. The toner for developing an electrostatic image according to claim 1, wherein the amount of the external additive A externally added to 100 parts by weight of the toner particle is from about 0.5 parts by weight to about 2.0 parts by weight.

8. The toner for developing an electrostatic image according to claim 1, wherein the amount of the external additive B externally added to 100 parts by weight of the toner particle is from about 0.1 parts by weight to about 5.0 parts by weight.

9. The toner for developing an electrostatic image according to claim 1, wherein the amount of the external additive B externally added to 100 parts by weight of the toner particle is from about 0.1 parts by weight to about 2.0 parts by weight.

10. The toner for developing an electrostatic image according to claim 1, wherein the content of nitrogen atoms in the particles having a core material covered with an organic material containing hydrogen and nitrogen is from about 0.5 atom % to about 3 atom % when measured by X-ray photoelectron spectroscopy under Ar etching with an Ar etching time of from 0 to 100 seconds.

11. The toner for developing an electrostatic image according to claim 10, wherein the content of nitrogen atoms is from about 1.0 atom % to about 2.5 atom %.

12. The toner for developing an electrostatic image according to claim 10, wherein the content of nitrogen atoms is from about 1.5 atom % to about 2.0 atom %.

13. A developer for developing an electrostatic image, comprising the toner for developing an electrostatic image according to any one of claim 1.

14. A toner cartridge accommodating at least a toner, wherein the toner is the toner for developing an electrostatic image according to claim 1.

15. A process cartridge comprising:

an electrostatic latent image holder; and a developing unit that develops an electrostatic latent image formed on the electrostatic latent image holder with the developer for developing an electrostatic image according to claim 13 to form a toner image, the process cartridge being attachable to and detachable from an image forming apparatus main body.

16. An image forming apparatus comprising:

an electrostatic latent image holder;

a developing unit that develops an electrostatic latent image formed on the electrostatic latent image holder with the developer for developing an electrostatic image according to claim 13 to form a toner image;

a transfer unit that transfers the toner image formed on the electrostatic latent image holder onto a transfer receiving material;

a fusing unit that fuses the transferred toner image on the transfer receiving material;

a cleaning unit that removes a residual toner remaining on the electrostatic latent image holder after transfer, by scraping the electrostatic latent image holder with a cleaning blade; and a residual toner carrying unit that carries the residual toner collected by the cleaning unit.

* * * * *